US006906676B2

(12) United States Patent
Killen et al.

(10) Patent No.: US 6,906,676 B2
(45) Date of Patent: Jun. 14, 2005

(54) FSS FEEDING NETWORK FOR A MULTI-BAND COMPACT HORN

(75) Inventors: William D. Killen, Melbourne, FL (US); Heriberto J. Delgado, Melbourne, FL (US); Michael S. Zarro, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 23 days.

(21) Appl. No.: 10/706,150

(22) Filed: Nov. 12, 2003

(65) Prior Publication Data

US 2005/0099352 A1 May 12, 2005

(51) Int. Cl.[7] ..... H01Q 5/12

(52) U.S. Cl. ..... 343/786; 343/771; 343/909; 333/21 A; 333/134

(58) Field of Search ..... 343/754, 756, 343/771, 772, 786, 909; 333/21 A, 106, 108, 134

(56) References Cited

U.S. PATENT DOCUMENTS 3,842,421 A * 10/1974 Rootsey et al. ..... 343/909
5,373,302 A * 12/1994 Wu ..... 343/781 P
5,394,163 A * 2/1995 Bullen et al. ..... 343/771
6,208,316 B1 * 3/2001 Cahill ..... 343/909
6,323,819 B1 * 11/2001 Ergene ..... 343/786
6,816,026 B2 * 11/2004 Dybdal ..... 333/21 A

FOREIGN PATENT DOCUMENTS

WO PCT/GB92/01173 6/1992

OTHER PUBLICATIONS

"*Wave guidance and radiation from a hollow tube formed from frequency–selective surfaces*," A.J. Robinson, J.C. Vardaxoglou, and R.D. Seager, Electronics Letters, Aug. 19, 1993, vol. 29, No. 17.

(Continued)

*Primary Examiner*—Tho Phan
(74) *Attorney, Agent, or Firm*—Sacco & Associates, PA

(57) ABSTRACT

A feed structure (105) for a horn antenna (100). The feed structure can include a first waveguide (110) and a second waveguide (115) having a first portion at least partially disposed within the first waveguide. The second waveguide also can include a second portion intersecting a first wall (240) of the first waveguide. The first wall can include a first frequency selective surface (244) at an intersection (280) of the first wall and the second portion of the second waveguide. The first waveguide can be operatively coupled to a first horn section (130) and the second portion can be operatively coupled to a second horn section (135).

26 Claims, 2 Drawing Sheets

OTHER PUBLICATIONS

"*Realisation of frequency selective horn antenna incited from passive array*," J.C. Vardaxoglou, R.D. Seager and A.J. Robinson, Electronics Letters, Oct. 8, 1992, vol. 28, No. 21.
"*Development of a 7.2–, 8.4–, and 32–Gigahertz (X–/X–/Ka–BAnd) Three–Frequency Feed for the Deep Space Network*," Stanton, P.H.; Hoppe, D.J., and Reilly, H. TMO Progress Report 42–145, May 15, 2001.
"*Frequency Selective Surfaces in the GHz and the THz Region: Analysis and Experimental Results*," Bozzi, Maurizio and Perregrini, Luca. Terahertz and Gigahertz Electronics and Photonics, II. Proceedings of SPIE Vo. 4111 (2000).
"*Arrays of Concentric Rings as Frequency Selective Surfaces*," Parker, E.A., Hamday, S.M.A., and Langley, R.J. Electronics Letters, Nov. 12, 1981, vol. 17, No. 23.
"*Single–Layer Multiband Frequency–Selective Surfaces*," Lee, C.K., Langley, R.J., and Parker, E.A. IEE Proceedings, Vo. 132, Pt. H. No. 6, Oct. 1985.
"*Frequency Selective Surfaces*, " Parker, E.A., Langley, R.J., Cahill, R., and Vardaxoglou, J.C. Electronics Laboratories, The University of Kent, Canterbury, UK. p. 459.
"*Novel 'Soft' Horn Antenna for Multiband Operation*," Vardaxoglou, J.C., Seager, Robert D., Robinson, Alan J. Loughborough University of Technology, Department of Electronic and Electrical Engineering, Loughborough Leicestershire LE 11 3TU.

* cited by examiner

FSS FEEDING NETWORK FOR A MULTI-BAND COMPACT HORN

BACKGROUND OF THE INVENTION

1. Statement of the Technical Field

The inventive arrangements relate generally to methods and apparatus for horn antennas, and more particularly to horn antennas which can operate in multiple frequency bands.

2. Description of the Related Art

Conventional electromagnetic waveguides and horn antennas are well known in the art. A waveguide is a transmission line structure that is commonly used for microwave signal transmission. A horn antenna (horn) is a particular type of waveguide which is optimized for wireless propagation and reception of RF signals through free space. Horns typically have a conical or pyramidal shape. In a common configuration, a narrow end of the horn is operatively connected to one end of a feed structure, which itself includes a waveguide. A feed probe is usually installed at an end of the feed structure which is opposite of the end of the feed structure that is joined with the horn. The feed probe couples the horn to transmit and/or receive circuitry and is typically optimized for operation in the particular frequency band for which the horn is designed to operate.

The horn and feed structure typically include a material medium that confines and guides propagating electromagnetic waves. In a horn or feed structure, as with most other waveguides, a "mode" is one of the various possible patterns of propagating electromagnetic fields. Each mode is characterized by frequency, polarization, electric field strength, and magnetic field strength. Each horn configuration can form different transverse electric and transverse magnetic modes. Since horns are generally designed to have a static geometry, the operational frequency and bandwidth of conventional horns are limited.

To overcome the frequency and bandwidth limitations of horns, International Patent Application No. PCT/GB92/01173 assigned to Loughborough University of Technology (Loughborough) proposes that a frequency selective surface (FSS) can be used within a horn to influence the frequency response. An FSS is typically provided in one of two arrangements. In a first arrangement, two or more layers of conductive elements are separated by a dielectric substrate. The elements are selected to resonate at a particular frequency at which the FSS will become reflective. The distance between the element layers is selected to create a bandpass condition at a fundamental frequency at which the FSS becomes transparent and passes a signal. The FSS also can pass harmonics of the fundamental frequency. For example, if the fundamental frequency is 10 GHz, the FSS can pass 20 GHz, 30 GHz, 40 GHz, and so on.

Alternatively, FSS elements can be apertures in a conductive surface. The dimensions of the apertures can be selected so that the apertures resonate at a particular frequency. In this arrangement, the FSS elements pass signals propagating at the resonant frequency. Any other electromagnetic waves incident on the FSS surface are reflected from the surface. In a multi-band horn, the FSS can form a second horn within a first horn wherein the second horn and the first horn are tuned to different frequencies.

Hence, it would be desirable for a multi-band horn antenna to have multiple feed probes, with at least one probe being optimized for the operational frequency of each horn within the multi-band antenna. However, the coaxial nature of the feed structures in the multi-band horn antenna proposed by Loughborough prevents multiple feed probes from being incorporated into the multi-band horn antenna in a conventional fashion. Accordingly, there exists a need for a feed structure having multiple feed probes which can be used with a multi-band horn antenna having FSS's.

SUMMARY OF THE INVENTION

The present invention relates to a feed structure for a horn antenna. The feed structure can include a first waveguide and a second waveguide having a first portion at least partially disposed within the first waveguide. The second waveguide also can include a second portion intersecting a first wall of the first waveguide. The first wall can include a first frequency selective surface at an intersection of the first wall and the second portion of the second waveguide. The first waveguide can be operatively coupled to a first horn section and the second portion can be operatively coupled to a second horn section.

The first portion of the second waveguide can include at least one wall having a second frequency selective surface. A first feed probe can be disposed within the first waveguide, wherein RF signals generated by the first feed probe are reflected by the first frequency selective surface. The RF signals generated by the first feed probe can also propagate through the second frequency selective surface.

The feed structure can also include a second feed probe disposed within the second portion of the second waveguide, wherein RF signals generated by the second feed probe can propagate through the first frequency selective surface or be reflected by the second frequency selective surface.

The feed structure can further include a third waveguide including a first portion at least partially disposed within the second waveguide, a second portion intersecting a wall of the second waveguide, and a third portion intersecting at least one of the first wall and a second wall of the first waveguide. The second waveguide wall can include a third frequency selective surface at an intersection of the second waveguide and the second portion of the third waveguide. The first or second wall of the first waveguide can include a fourth frequency selective surface at an intersection of the third portion of the third waveguide and the first or a second wall.

The third waveguide can be operatively coupled with a third horn section. The first portion of the third waveguide can include at least one wall having a fifth frequency selective surface. The feed structure of the third waveguide can further include a first feed probe disposed within the first waveguide, wherein RF signals generated by the first feed probe propagate through the third and fifth frequency selective surfaces or are reflected by the fourth frequency selective surface. A second feed probe can also be disposed within the second portion of the second waveguide, wherein RF signals generated by the second feed probe propagate through the fifth frequency selective surface or are reflected by the third frequency selective surface.

Finally, a third feed probe can be disposed within the third portion of the third waveguide, wherein RF signals generated by the third feed probe propagate through the third and fourth frequency selective surfaces or are reflected by the fifth frequency selective surface.

A present invention also relates to a waveguide combining network. The waveguide combining network can include a first waveguide having at least a first wall and a second waveguide intersecting the first wall. The first wall can include a first frequency selective surface at the intersection of the first wall and the second waveguide. RF signals propagating within the second waveguide can propagate through the first frequency selective surface and RF signals propagating within the first waveguide can be reflected by the first frequency selective surface.

Further, the waveguide combining network also can include a third waveguide intersecting the first wall and/or a second wall of the first waveguide. A second frequency selective surface can be provided at the intersection of the third waveguide and first wall and/or the second wall. RF signals propagating within the third waveguide can propagate through the second frequency selective surface and RF signals propagating within the first waveguide can be reflected by the second frequency selective surface.

DETAILED DESCRIPTION OF THE PREFERRED EMBODIMENTS

An embodiment of the present invention concerns a feed structure for use with a multi-band horn antenna. The feed structure includes a waveguide combiner network which can include a plurality of waveguides that are operatively coupled to antenna horns. For example, a waveguide can be provided for each of a plurality of coaxial horns. Further, a feed probe can be provided for each of the waveguides. Accordingly, the feed probes can be optimized for the horns with which they are used.

Frequency selective surfaces (FSS's), which are known in the art, can be selectively incorporated into walls of the waveguides such that the waveguides are reflective at selected frequencies and transparent at other selected frequencies. For instance, a particular waveguide can be reflective for RF signals generated by a feed probe associated with the waveguide, yet be transparent to RF signals generated by feed probes associated with other waveguides within the feed structure. Accordingly, the waveguides can be disposed in a desired arrangement, for example coaxially, with little or no adverse affect on feed structure performance. Moreover, the waveguides also can intersect one another without significant loss of performance.

Figure 1:
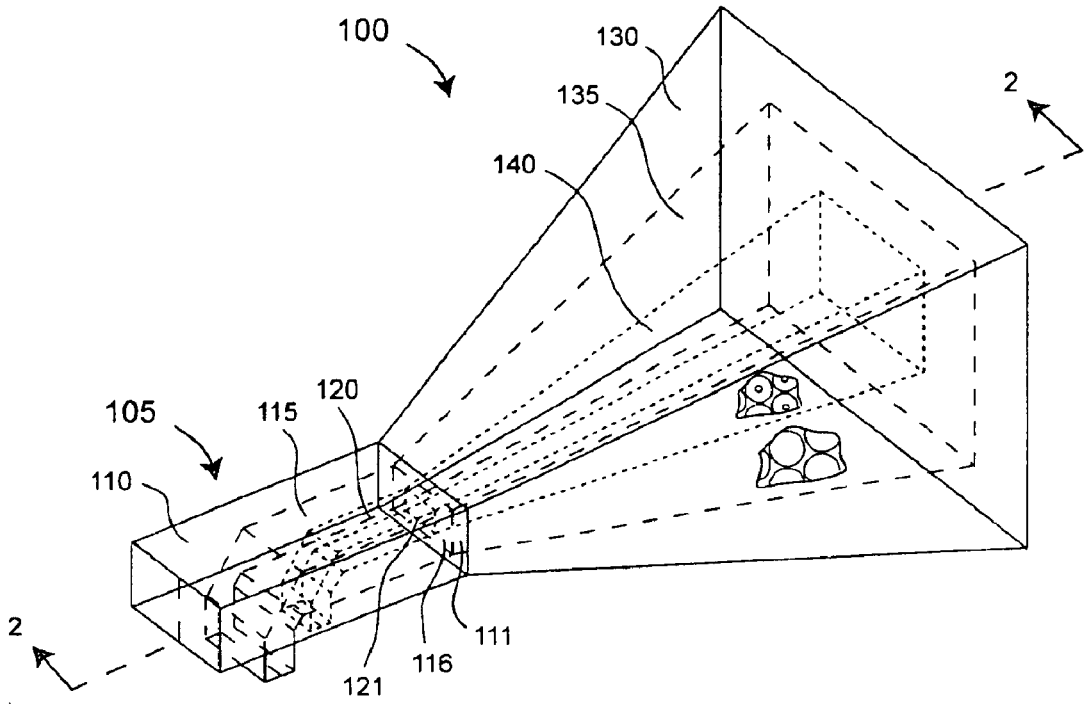
FIG. 1 is a perspective view of a multi-band horn antenna having an alternate waveguide arrangement that is useful for understanding the present invention.

Referring to FIG. 1, a multi-band horn antenna 100 having a multi-band feed structure 105 is shown. The multi-band feed structure 105 can include a plurality of waveguides, for example a first waveguide 110, and a second waveguide 115 at least partially disposed within the first waveguide 110. The multi-band feed structure 105 also can include additional waveguides. For instance, a third waveguide 120 can be at least partially disposed within the second waveguide 115, and a fourth waveguide (not shown can be disposed within the third waveguide, and so on. Importantly, the invention is not limited to a specific number of waveguides; any number of waveguides can be used. Further, each of the waveguides can be operatively connected to a horn. For example, waveguide 110 can be operatively connected to a horn 130, waveguide 115 can be operatively connected to a horn 135, and waveguide 120 can be operatively connected to a horn 140. Further, horns can be provided, for example in the instance there are more than three waveguides.

In one embodiment, output portions 111, 116, 121 of the waveguides 110, 115, 120, respectively, can be coaxially arranged, as shown. This arrangement is beneficial for use with coaxially positioned horns. In another arrangement, output portions 116, 121 of second and third waveguides 115, 120 can be positioned side by side within the first waveguide 110, for example when associated horns are provided that have a side by side configuration. Still, the invention is not so limited and other waveguide arrangements can be provided. Notably, the waveguides 110, 115, 120 can be rectangular, squared, cylindrical, elliptical or any other shape which would support a guided wave. Moreover, the horns 130, 135, 140 can be conical, pyramidal or any type of feed horn that can be receive a guided wave from the waveguides.

Figure 2:
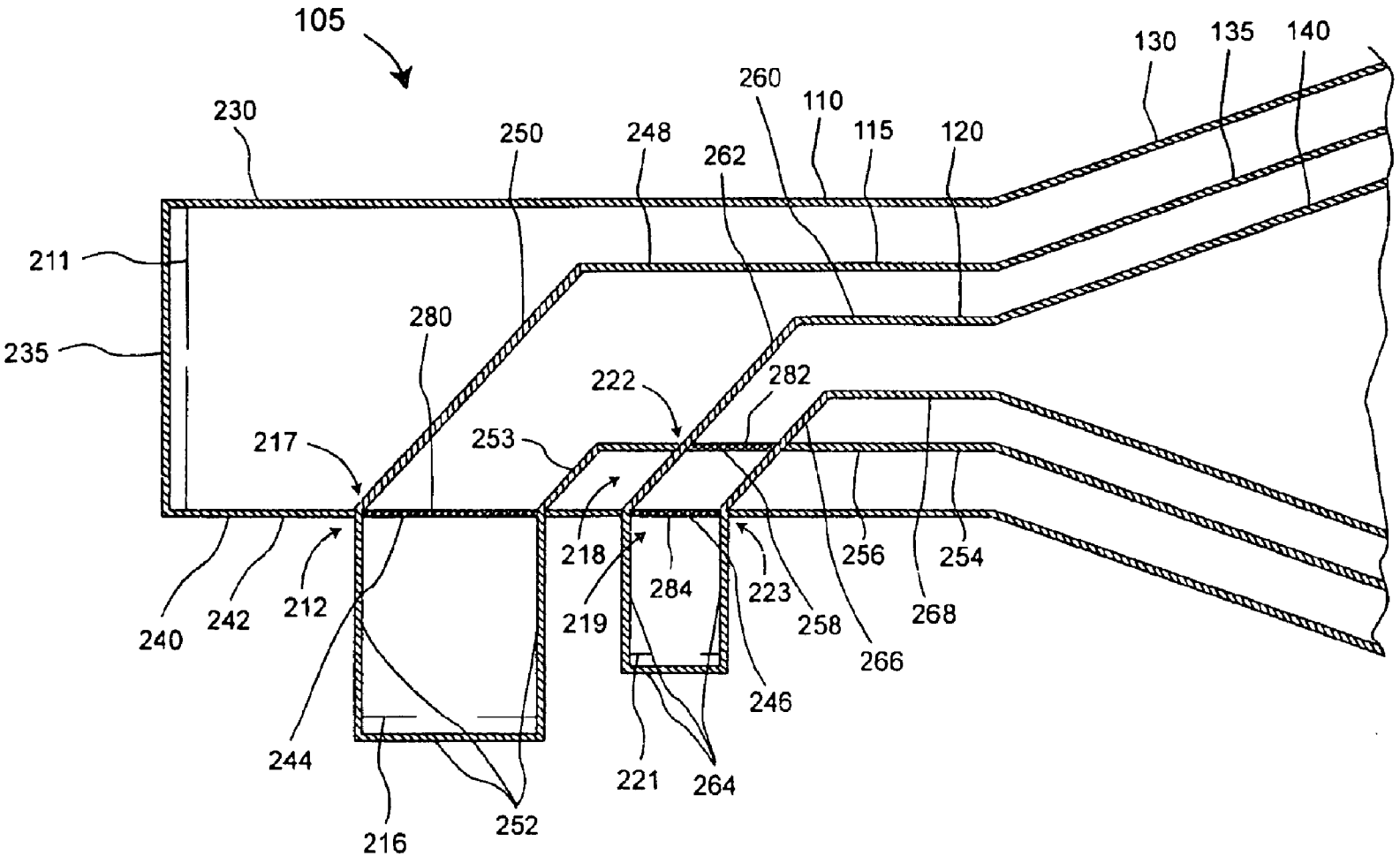
FIG. 2 is a cross sectional view of a waveguide assembly of the multi-band horn antenna of FIG. 1 taken along section lines 2—2.

A cross sectional view of the multi-band feed structure 105 taken along section lines 2—2 is shown in FIG. 2. Each of the waveguides can be provided with one or more feed probes. For instance, a first feed probe 211 can be provided with the first waveguide 110, a second feed probe 216 can be provided with the second waveguide 115, and a third feed probe 221 can be provided with the third waveguide 120. The feed probes 211, 216, 221 can be used to generate RF signals within the waveguides. For example, the feed probes can be connected to circuitry which supplies RF signals to, or receives RF signals from, the feed probes. In the preferred arrangement, each of the feed probes 211, 216, 221 can be optimized for the operational frequency of the waveguide and horn with which it is associated. Significantly, the present invention is not limited to any particular feed probe configuration. For example, the linear vertical, linear horizontal and circular polarization feed probes can be used.

The multi-band feed structure 105 can provide excellent horn feed characteristics for the multi-band horn antenna 100. In particular, the waveguides 110, 115, 120 can be arranged so that each feed probe 211, 216, 221 can be isolated within its associated waveguide 110, 115, 120, respectively. In consequence, coupling and interference between the feed probes 211, 216, 221 is minimized. Coupling between the waveguides 110, 115, 120 also is minimized.

As shown, a portion 217 of waveguide 115 can intersect with a portion 212 of waveguide 110 at intersection 280. Further, a portion 222 of waveguide 120 can intersect with a portion 218 of wave guide 115 at intersection 282, and a portion 223 of waveguide 120 can intersect with a portion 219 of waveguide 110 at intersection 284. Each of the waveguides can include a plurality of surfaces to enable proper waveguide operation, even though the waveguides can have portions which are coaxially positioned and other portions which intersect one another.

For instance, the first waveguide 110 can include conductive surfaces, dielectric surfaces, FSS's, or a combination of such surfaces. In one arrangement, waveguide walls (walls) 230, 235 can be conductive. Wall 240 can comprise conductive portions 242 and FSS portions 244, 246. FSS portion 244 can be disposed at the intersection 280 of the waveguide 110 and the waveguide 115. FSS portion 244 can be configured to reflect RF signals generated by the feed probe 211 and pass RF signals generated by the feed probe 216. Similarly, FSS portion 246 can be disposed at the intersection 284 of waveguide 110 and waveguide 120. FSS portion 246 can be configured to reflect RF signals generated by feed probe 211 and pass RF signals generated by feed probe 221.

Waveguide 115 can include walls 248, 250, 252, 253 and 254. Walls 252 can be conductive. Wall 254 can include a portion 258 which intersects waveguide 120 at the intersection 282, and a remaining non-intersecting portion 256. Walls 248, 250, 253 and portion 256 of wall 254 can be FSS's which pass RF signals generated by feed probe 211, but are reflective to RF signals generated by feed probe 216. Portion 258 of wall 254 also can be an FSS. Portion 258, however, can pass RF signals generated by the feed probe 211 and RF signals generated by feed probe 221. Further, the portion 258 can be reflective to RF signals generated by feed probe 216.

Lastly, waveguide 120 can include waveguide walls 260, 262, 264, 266, 268. Walls 264 can be conductive. Walls 260, 262, 266, 268 can be FSS's which are reflective to RF signals generated by feed probe 221, and pass RF signals generated by feed probes 211, 216.

Accordingly, RF signals generated by feed probe 211 can be propagated to horn 130 via waveguide 110 with minimal interference from waveguides 115, 120. Likewise, RF signals generated by feed probe 216 can be propagated to horn 135 via waveguide 115 with minimal interference from waveguides 110, 120. Finally, RF signals propagated by feed probe 221 can be propagated to horn 140 via waveguide 120 with minimal interference from waveguides 110,115. In consequence, each feed probe 211, 216, 221 can be optimized for the operational frequency of the waveguide 110, 115, 120 and horn 130, 135, 140, respectively, with which it is associated.

In a preferred arrangement, each FSS is optimized for the angle of incidences of RF signals to which the FSS should be passive or reflective. In particular, walls 248, 254, 260, 268 can be optimized for their orientation within the multi-band feed structure 105, for example with respect to feed probes 211, 216 and walls 230, 240. Similarly, walls 250, 253, 262, 266 can be optimized for their orientation within the multi-band feed structure 105. For example, the FSS's of walls 250, 253, 262, 266 can be selected for optimal performance for an RF signal having an angle of incidence upon the walls 250, 253, 262, 266.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A feed structure for a horn antenna comprising:

a first waveguide having at least a first wall; and a second waveguide comprising a first portion at least partially disposed within said first waveguide and a second portion intersecting said first wall;

wherein said first wall comprises a first frequency selective surface at an intersection of said first wall and said second portion of said second waveguide.

2. The feed structure of claim 1 wherein said first waveguide is operatively coupled to a first horn section.

3. The feed structure of claim 1, wherein said second portion is operatively coupled to a second horn section.

4. The feed structure of claim 1, wherein said first portion of said second waveguide includes at least one wall comprising a second frequency selective surface.

5. The feed structure of claim 4 further comprising a first feed probe disposed within said first waveguide.

6. The feed structure of claim 5 wherein RF signals generated by said first feed probe are reflected by said first frequency selective surface.

7. The feed structure of claim 5 wherein RF signals generated by said first feed probe propagate through said second frequency selective surface.

8. The feed structure of claim 4 further comprising a second feed probe disposed within said second portion of said second waveguide.

9. The feed structure of claim 8 wherein RF signals generated by said second feed probe propagate through said first frequency selective surface.

10. The feed structure of claim 8 wherein RF signals generated by said second feed probe are reflected by said second frequency selective surface.

11. The feed structure of claim 1 further comprising a third waveguide, said third waveguide comprising:

a first portion at least partially disposed within said second waveguide;

a second portion intersecting a wall of said second waveguide; and a third portion intersecting at least one of said first wall and a second wall of said first waveguide;

wherein said second waveguide wall comprises a third frequency selective surface at an intersection of said second waveguide and said second portion of said third waveguide; and said at least one of said first and second wall of said first waveguide comprises a fourth frequency selective surface at an intersection of said third portion of said third waveguide and said at least one of said first and second wall.

12. The feed structure of claim 11, wherein said third waveguide is operatively coupled with a third horn section.

13. The feed structure of claim 11, wherein said first portion of said third waveguide includes at least one wall comprising a fifth frequency selective surface.

14. The feed structure of claim 13 further comprising a first feed probe disposed within said first waveguide.

15. The feed structure of claim 14 wherein RF signals generated by said first feed probe propagate through said third and fifth frequency selective surfaces.

16. The feed structure of claim 14 wherein RF signals generated by said first feed probe are reflected by said fourth frequency selective surface.

17. The feed structure of claim 13 further comprising a second feed probe disposed within said second portion of said second waveguide.

18. The feed structure of claim 17 wherein RF signals generated by said second feed probe propagate through said fifth frequency selective surface.

19. The feed structure of claim 17 wherein RF signals generated by said second feed probe are reflected by said third frequency selective surface.

20. The feed structure of claim 13 further comprising a third feed probe disposed within said third portion of said third waveguide.

21. The feed structure of claim 20 wherein RF signals generated by said third feed probe propagate through said third and fourth frequency selective surfaces.

22. The feed structure of claim 20 wherein RF signals generated by said third feed probe are reflected by said fifth frequency selective surface.

23. A waveguide combining network comprising:

a first waveguide having at least a first wall; and a second waveguide intersecting said first wall;

wherein said first wall comprises a first frequency selective surface at an intersection of said first wall and said second waveguide.

24. The waveguide combining network of claim 23, wherein RF signals propagating within said second waveguide propagate through said first frequency selective surface and RF signals propagating within said first waveguide are reflected by said first frequency selective surface.

25. The waveguide combining network of claim 23 further comprising:

a third waveguide intersecting at least one of said first wall and a second wall of said first waveguide;

wherein said at least one of said first wall and said second wall comprises a second frequency selective surface at an intersection of said third waveguide and said at least one of said first wall and said second wall.

26. The waveguide combining network of claim 25, wherein RF signals propagating within said third waveguide propagate through said second frequency selective surface and RF signals propagating within said first waveguide are reflected by said second frequency selective surface.

* * * * *